US011081333B2

(12) United States Patent
Kudo et al.

(10) Patent No.: US 11,081,333 B2
(45) Date of Patent: Aug. 3, 2021

(54) POWER CONNECTOR FOR MASS SPECTROMETER

(71) Applicant: SHIMADZU CORPORATION, Kyoto (JP)

(72) Inventors: Tomoya Kudo, Kyoto (JP); Daisuke Okumura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/118,643

(22) Filed: Aug. 31, 2018

(65) Prior Publication Data

US 2020/0075305 A1 Mar. 5, 2020

(51) Int. Cl.

*H01J 49/00* (2006.01)
*H01J 49/40* (2006.01)
*H01J 49/06* (2006.01)

(52) U.S. Cl.

CPC ..... *H01J 49/405* (2013.01); *H01J 49/063* (2013.01)

(58) Field of Classification Search

CPC ..... H01J 49/00; H01J 49/02; H01J 49/022; H01J 49/26; H01J 49/405

USPC ..... 250/281, 282, 299, 294

See application file for complete search history.

(56) References Cited

U.S. PATENT DOCUMENTS 4,925,399 A * 5/1990 Bosworth ..... H01R 13/6392 439/369
5,689,111 A 11/1997 Dresch et al.
6,556,654 B1 * 4/2003 Hansen ..... H05G 1/02 378/101
6,812,453 B2 11/2004 Bateman et al.
7,513,803 B1 * 4/2009 Yang ..... H01R 4/4818 439/352
2012/0181257 A1 * 7/2012 Mather ..... B23K 10/006 219/121.48
2014/0239170 A1 8/2014 Okumura
2015/0179421 A1 * 6/2015 Jarrell ..... H01J 49/405 250/505.1

FOREIGN PATENT DOCUMENTS

JP 2014-165053 A 9/2014
JP 2015-118887 A 6/2015

* cited by examiner

*Primary Examiner* — Jason L McCormack
(74) *Attorney, Agent, or Firm* — Sughrue Mion, PLLC

(57) ABSTRACT

Even if vibration is applied to an electrode, a connector section is not separated due to urge of a spring section by using a mass spectrometer that includes an electrode (plate-like electrode); a power source section that supplies electric power to the electrode with a predetermined voltage and/or current; a connection line formed of a conductive wire rod having elasticity for electrically connecting the electrode and the power source section; a connector section provided at one end of the connection line; a seat provided in the electrode to be contacted with the connector section; a fixation section provided in the connection line to be fixed to the power source section; and a spring section formed between the connector section and the fixation section of the connection line or in the connector section and for urging the connector section to the seat.

10 Claims, 4 Drawing Sheets

POWER CONNECTOR FOR MASS SPECTROMETER

TECHNICAL FIELD

The present invention relates to a mass spectrometer, in particular, to a mass spectrometer characterized by a connection structure for electrically connecting an electrode and a power source included in the mass spectrometer.

BACKGROUND ART

As an example of mass spectrometer, a time-of-flight mass spectrometer is described in Patent Literature 1. In this time-of-flight mass spectrometer 90, as shown in FIG. 9, an extrusion electrode 921 and a grid electrode (extraction electrode) 922 as ion accelerating sections 92 for accelerating ion are disposed in an ion introduction section 91 which introduces an ion to be measured, and a reflection electrode 94 formed of a number of plate-like electrodes is disposed at a terminating end of a flight space 93. At the time of measurement, inside the time-of-flight mass spectrometer 90 is brought to a high-vacuum state by a vacuum pump 80. The ion to be measured is introduced into the ion introduction section 91, and is accelerated towards the flight space 93 by an electric field formed by the extrusion electrode 921 and the grid electrode 922. The accelerated ion flies in the flight space 93, turns back due to a reflection electric field formed by the reflection electrode 94, flies again in the flight space 93, and reaches an ion detector 98. Based on the time from the time point when the ion starts acceleration to the time point when it enters the ion detector 98, the mass-to-charge ratio of the ion can be measured.

Thus, the time-of-flight mass spectrometer 90 includes various electrodes for forming electric fields, and a predetermined voltage is applied to each electrode. For example, the reflection electrode 94 is connected via connection lines 97 to a power source board 95 disposed on a side of the flight space 93. The power source board 95 is connected via vacuum feedthroughs 96 to a power source 99 disposed outside of the time-of-flight mass spectrometer 90.

CITATION LIST

Patent Literature

Patent Literature 1: JP 2014-165053 A
Patent Literature 2: JP 2015-118887 A (FIGS. 1 to 4)
Patent Literature 3: U.S. Pat. No. 5,689,111 A (FIG. 2)
Patent Literature 4: U.S. Pat. No. 6,812,453 B2

SUMMARY OF INVENTION

Technical Problem

For the power source board 95, a printed board is normally used, and each of the connection lines 97, which connects the power source board 95 to each electrode, is electrically connected by soldering. Each of the reflection electrodes 94 is normally formed of a metal plate such as aluminum or stainless steel, and each of the reflection electrodes 94 and each of the connection lines 97 are electrically connected by spot welding. On the other hand, since a rotating member such as a fin rotates at high speed inside of the vacuum pump 80, which is used to evacuate the inside of the time-of-flight mass spectrometer 90 as described earlier, the time-of-flight mass spectrometer 90 is vibrated due to the vibration generated by this rotation. If the reflection electrode 94 and the connection line 97 are not adequately fixed by spot welding, a problem arises in that this vibration may separate the reflection electrode 94 and the connection line 97. Besides the vibration by the vacuum pump 80, vibration or impact at the time of transportation may also separate the reflection electrode 94 and the connection line 97. In particular, in a case of a stacked electrode formed of a number of electrodes and connected to the connection lines by conventional spot welding and the like such as the reflection electrode 94 of the time-of-flight mass spectrometer described in Patent Literature 1, when one of the connection lines 97, through which voltage is applied to each electrode, is separated, it is difficult to reconnect or repair it on site. In addition, in a case where fixation of such a spot welding section is not adequate, there is a problem that, even if electrical contact itself is maintained, the contact state is poor, voltage applied from the power source 99 is likely to become unstable due to vibration of the vacuum pump or the like, and the mass accuracy, the mass resolution, and the sensitivity of the mass spectrometer become unstable.

Such a problem has occurred also in the extrusion electrode 921 and the grid electrode 922. In addition, such a problem can also occur in the stacked ion guide electrode that is an acceleration electrode in a flight space described in Patent Literature 2 and in the stacked ion guide electrode provided on the near side of the ion introduction section described in Patent Literature 3. In addition, a similar problem may occur in, other than a time-of-flight mass spectrometer, various stacked electrodes used for a mass spectrometer, such as the multi-aperture ion guide electrode disclosed in Patent Literature 4.

The problem to be solved by the present invention is to provide a mass spectrometer that is capable of maintaining a good connection state of the electrode and the power source even if vibration or impact due to transport or vibration due to the rotation drive mechanism or the like are applied and capable of reconnecting with ease even if the connection between the electrode and the power source is separated.

Solution to Problem

A mass spectrometer according to the present invention provided in order to solve the problem mentioned above includes:

a) an electrode;

b) a power source section that supplies electric power to the electrode with a predetermined voltage and/or current;

c) a connection line formed of a conductive wire rod having elasticity for electrically connecting the electrode and the power source section;

d) a connector section provided at one end of the connection line;

e) a seat provided in the electrode to be contacted with the connector section;

f) a fixation section provided in the connection line to be fixed to the power source section; and g) a spring section formed between the connector section and the fixation section of the connection line or in the connector section and for urging the connector section to the seat.

In the mass spectrometer according to the present invention, the fixation section of the connection line is fixed to the power source section and the connector section contacts the seat of the electrode, and hence the power source section and the electrode are electrically connected via the connection line. Here, since the connector section is urged to the seat by the spring section, the connector section is pressed to the seat by the urging force of the spring section, and the connector section and the seat are not separated even if an ordinary vibration is applied to the device. In addition, if a vibration that exceeds the frictional force of this connector section is applied, the connector section absorbs the vibration by being displaced, and thus, while maintaining good electrical connection, no excessive force is applied to the connection line and the connector section. If a greater vibration is applied, the connector section is separated, which causes the electrical connection to be cut off, but the worse situations are avoided such as disconnection of the connection line and damage of the connecting section (connector section). Then, in such a case, reconnection can be made easily without soldering, welding, and the like.

The power source section supplies electric power with a predetermined voltage and/or current to the electrode, and normally includes an electric circuit that adjusts electric power from a commercial power source or a battery to the predetermined voltage and/or current. In addition, in a case of distributing electric power to a plurality of electrodes, the power source section may include an electric circuit for the distribution. The fixation section of the connection line can be fixed to a printed board on which those electric circuits are formed, for example. In that case, it is possible to effect the fixation to the printed board by inserting a connection line into a hole provided on the printed board and soldering the connection line to the printed board.

The spring section can be formed by winding the connection line in the form of torsion spring or helical spring. In addition, the spring section may be provided between the connector section and the fixation section, separately from the connector section, so that the connector section is urged to the seat of the electrode, or the spring section itself can be used as a connector section by winding the connection line multiple times and by sandwiching the seat of the electrode between two neighboring winding sections.

It is desirable that the connector section and the seat have an insertion structure in which one is male and the other is female. Due to this, it is more difficult for the connector section to be separated from the seat.

The connection structure of the electrode and the power source of a mass spectrometer according to the present invention can preferably be applied to a stacked electrode used for transporting an ion in a flight space of a time-of-flight mass spectrometer. Examples of such a stacked electrode include an electrode in which a plurality of acceleration electrodes are stacked, an electrode in which an extrusion electrode, and extraction electrode, and a plurality of acceleration electrodes are stacked, a reflection electrode (reflectron), and a stacked electrode provided on the near side of the ion introducing section. In addition, the connection structure of the electrode and the power source of the mass spectrometer according to the present invention can preferably be used for an ion guide electrode and a reflection electrode used not only in the time-of-flight mass spectrometer but also in the general mass spectrometer.

Advantageous Effects of Invention

According to a mass spectrometer according to the present invention, a connection line with a power source section is hardly separated from an electrode even if a vibration is applied, and a good connection state of the electrode and the power source can be maintained. In addition, even if the connection between the electrode and the power source is separated, the electrode and the power source can be easily reconnected.

DESCRIPTION OF EMBODIMENTS

A mass spectrometer according to an embodiment of the present invention is described with reference to the attached drawings.

Figure 1:
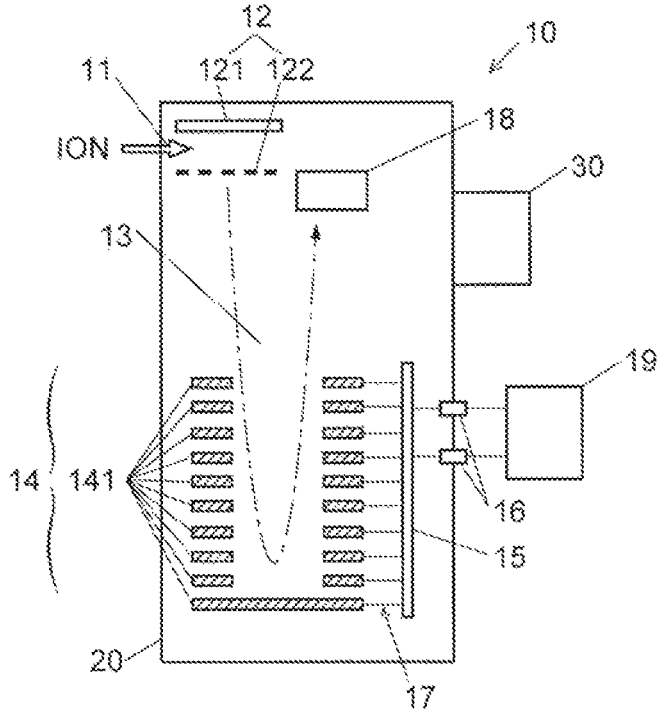
FIG. 1 is a schematic configuration diagram of a time-of-flight mass spectrometer according to the present invention.

FIG. 1 is a schematic configuration diagram of a time-of-flight mass spectrometer 10 according to an embodiment of the present invention. The time-of-flight mass spectrometer 10 includes, inside a housing 20, an ion introducing section 11 that introduces an ion to be measured, an extrusion electrode 121 and a grid electrode (extraction electrode) 122 as an ion accelerating section 12 that accelerates the ion introduced from the ion introducing section 11, a flight space 13 in which the ion flies with the ion accelerating section 12 as a starting end, a reflection electrode 14 disposed at a terminating end of the flight space 13, and an ion detector 18 that detects the ion reflected at the reflection electrode 14. The reflection electrode 14 and the detector 18 are respectively fixed to the housing 20 in a predetermined position. Furthermore, a power source board 15 is fixed inside the housing 20, the reflection electrode 14 is electrically connected to the power source board 15 via a plurality of connection lines 17. The power source board 15 is connected to a power source 19 provided outside of the housing 20 via vacuum feedthroughs 16 provided on a wall of the housing 20. The power source 19, the vacuum feedthroughs 16, and the power source board 15 correspond to a power source section of the present invention. A vacuum pump 30 that discharges the gas inside the housing 20 is provided outside the housing 20.

Figure 2A:
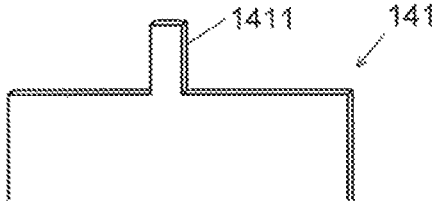
FIG. 2A shows a structure of an electrode.

The reflection electrode 14 is made up of a plurality of plate-like electrodes 141 formed by metal plates of stainless steel stacked at predetermined intervals. In each of the plate-like electrodes 141, except for the one in the rearmost end, is provided in the center with a hole through which the ion is allowed to pass. An outer edge of each of the plate-like electrodes 141 is provided with a rectangular-shaped seat 1411 that protrudes outward (FIG. 2A). In the time-of-flight mass spectrometer 10, the reflection electrode 14 is used as a reflectron that inverts the travelling direction of the ion. For each of the plate-like electrodes 141 of the reflection electrode 14, metal such as aluminum may be used other than stainless steel.

The power source board 15 is a printed board on which an electric circuit 151 is formed to convert a power source voltage from the power source 19 into a predetermined voltage and to apply it to each of the plate-like electrodes 141.

Figure 2B:
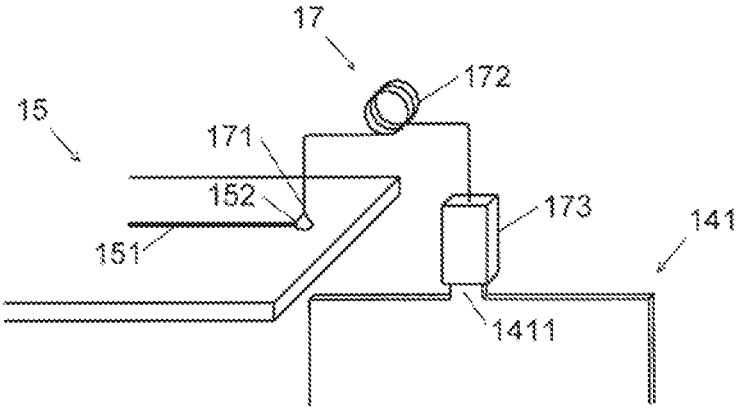
FIG. 2B shows a connection structure of an electrode and a power source section.

A connection line 17 is formed of a conductive wire rod having elasticity, and as shown in FIG. 2B, a spring section 172 is formed by winding a part of the connection line 17 in the form of torsion spring. A female flat crimp terminal is attached as a connector section 173 to an end of the connection line 17. The other end of the connection line 17 is inserted into a hole provided on the power source board 15 and is fixed to the power source board 15 by solder 152 so that it electrically conducts to the electric circuit 151. In this manner, a part of the connection line 17 fixed to the power source board 15 becomes a fixation section 171 in the present invention. It is to be noted that, similarly to the connector section 173, a connector attached to the other end of the connection line 17 may be a fixation section, and in this case, connection is carried out by providing the power source board 15 with a connection mechanism that corresponds to the connector.

As shown in FIG. 2B, the connection line 17 is bent into a rectangle shape, and the connector section 173 is disposed in such a manner as to face the seat 1411 of the plate-like electrodes 141. In addition, the spring section 172 is disposed in such a manner as to urge the connector section 173 in the direction of the seat 1411.

Figure 3A:
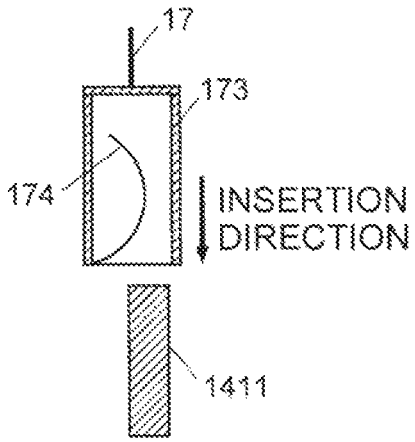
FIG. 3A is a sectional view that describes connection between a seat and a connector section, illustrating a state before the seat is inserted into the connector section.
Figure 3B:
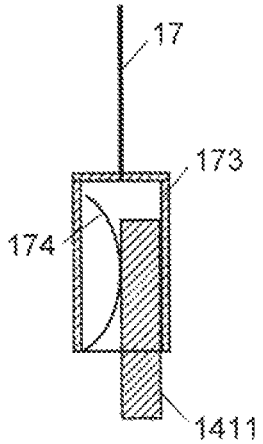
FIG. 3B is a sectional view that describes the connection between the seat and the connector section, illustrating a state after the seat is inserted into the connector section.

The connector section 173 and the seat 1411 have an insertable structure in which the former and the latter correspond to the female and the male, respectively. FIGS. 3A and 3B are sectional views that show states before and after the seat 1411 is inserted into the connector section 173, respectively. The connector section 173 includes a plate spring 174 in the inside. In a state where the seat 1411 is inserted into the connector section 173, the plate spring 174 presses the seat 1411 to an inner wall surface of the connector section 173 parallel to its insertion direction (FIG. 3B). It is to be noted that the plate spring 174 does not correspond to the spring section of the present invention.

Due to a structure similar to each of the plate-like electrodes 141 of the reflection electrode 14, the extrusion electrode 121 and the grid electrode 122 are also connected with a power source board provided in the proximity of them.

Next, the operation of the time-of-flight mass spectrometer 10 is described. Firstly, inside of the housing 20 is put into a high-vacuum state by the vacuum pump 30. Then, voltage is applied from the power source 19 to each of the electrodes. Once the ion to be measured is introduced into the ion introducing section 11, it is transported in the following manner due to an electric field formed by each of the electrodes. First, the ion is accelerated towards the flight space 13 due to an electric field formed by the extrusion electrode 121 and the grid electrode 122. The accelerated ion flies in the flight space 13, turns back due to a reflection electric field formed by the reflection electrode 14, flies again in the flight space 13, and reaches the ion detector 18. Based on the time from when the acceleration of the ion is started to when the ion enters the ion detector 18, a mass-to-charge ratio of the ion can be measured.

When the vacuum pump 30 is operated, vibration generated by the rotation mechanism in the vacuum pump 30 is transmitted to the entire time-of-flight mass spectrometer 10. Due to this, the reflection electrode 14, the power source board 15, and the like are vibrated, and since the spring section 172 urges the connector section 173 to the seat 1411 of the plate-like electrodes 141, the connector section 173 and the seat 1411 are not separated even if an ordinary vibration is applied and a good electrical contact is maintained in a state where the contact resistance between the connector section 173 and the seat 1411 is restrained. For this reason, the electrical field in the reflection electrode 14 becomes stable, and it is thus possible to prevent the mass accuracy, the mass resolution, and the sensitivity from becoming unstable.

Even if a greater vibration is applied and the connector section 173 is separated from the seat 1411, the reflection electrode 14, the connection line 17, and the like are not damaged. In addition, after the connection is cut off, reconnection is made possible with ease by a worker on the site inserting the connector section 173 into the seat 1411.

While in the embodiment described above, the connector structure in which the seat 1411 is male and the connector section 173 is female is adopted, the connector section may be male and the seat may be female.

Figure 4:
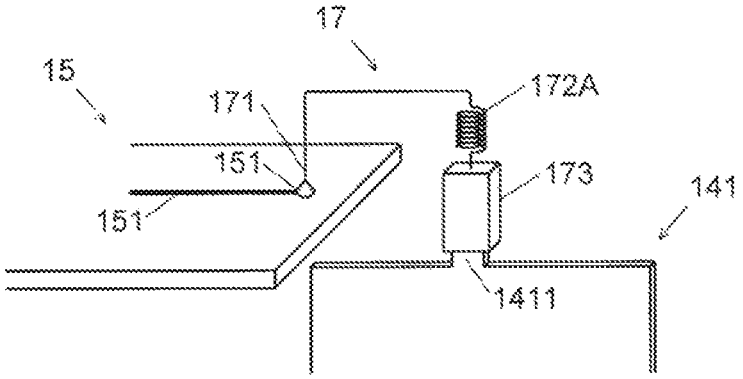
FIG. 4 shows a connection structure of an electrode and a power source section of Modification 1.

Next, another connection structure of the reflection electrode 14, the power source board 15, and the connection line 17 is described with reference to FIG. 4. In this modification, the structure and the arrangement of a spring section 172A are different from those in the embodiment described above, but the rest of the structure is the same. The spring section 172A is a compression spring provided in a state where a helical spring in which a wire rod of the connection line 17 positioned in the closest proximity of the connector section 173 is formed in a helical manner is compressed. Also, this modification is capable of having a similar effect to the embodiment described above because the connector section 173 is urged in the insertion direction of the seat 1411 due to expansion of the compressed spring section 172A.

Figure 5:
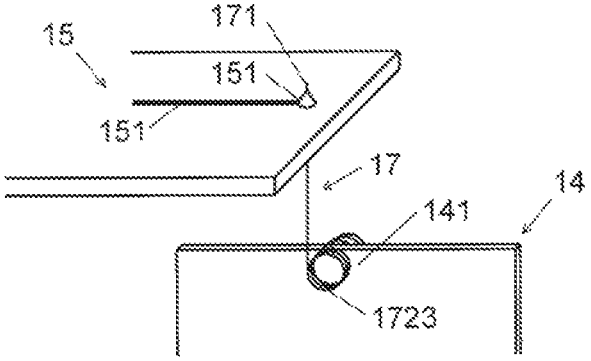
FIG. 5 shows a connection structure of an electrode and a power source section of Modification 2.

The second modification of connection structure of the reflection electrode 14, the power source board 15, and the connection line 17 is shown in FIG. 5. In this modification, the spring section is a tension spring, and the connection line 17 and the plate-like electrode 141 are connected by sandwiching the seat (part that contacts the winding section in the plate-like electrode 141) of the plate-like electrode 141 between winding sections. In other words, the spring section also serves as a connector section (spring section and connector section 1723). Since in this connection structure, the connection line 17 is formed only of a wire rod, it is possible to produce the connection line with ease.

Figure 6:
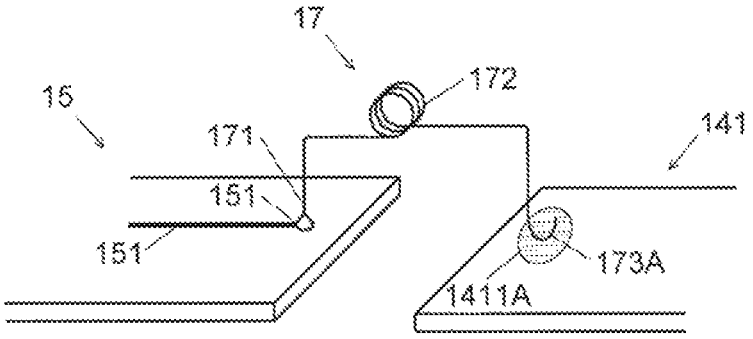
FIG. 6 shows a connection structure of an electrode and a power source section of Modification 3.

The third modification of connection structure of the reflection electrode 14, the power source board 15, and the connection line 17 is shown in FIG. 6. In this modification, the spring section 172 is a torsion spring, and an end of the connection line 17 is bent into a U shape, the bottom section of which is a connector section 173A. The plate-like electrode 141 is not provided with a seat that protrudes outward from the outer edge, and instead, the connector section 173A is caused to contact a part of the plate surface and the contact section is designated as a seat 1411A. In a case where a relatively weak vibration is applied, the connector section 173A is fixed to the seat 1411A by a static frictional force with the seat 1411A. If a vibration stronger than that is applied, the connector section 173A slides on the surface of the seat 1411A, but excessive force is not applied to the plate-like electrodes 141 and the connection line 17, and electrical connection is maintained. Since such sliding occurs, it is preferable to perform plating processing on the seat 1411A and protect the surface of the plate-like electrodes 141. If a further stronger vibration is applied, the connector section 173A is separated from the seat 1411A, which causes the electrical connection between the connector section 173A and the seat 1411A to be cut off but successfully prevents disconnection of the connection line 17 and damage of the connector section 173A. In addition, even if the connector section 173A is separated from the seat 1411A, a worker on the site can easily reconnect the connector section 173A and the seat 1411A simply by returning the connector section 173A to the seat 1411A. Also in this modification, since the connection line 17 is formed only of a wire rod, it is possible to produce the connection line with ease.

Figure 7:
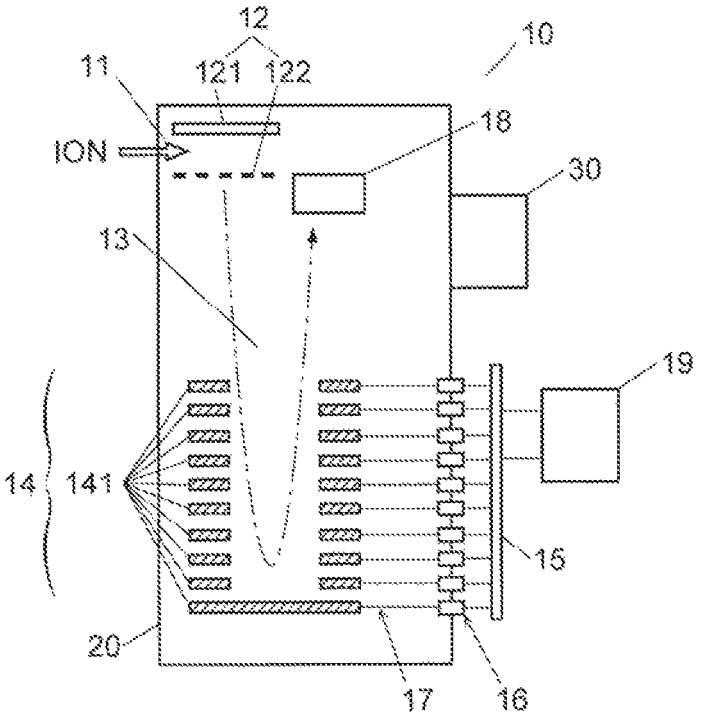
FIG. 7 is a schematic configuration diagram of a time-of-flight mass spectrometer in which a power source board is disposed outside of a housing.

While in the embodiment described above, the power source board is disposed inside of the housing, the power source board may be disposed outside the housing. In this case, as shown in FIG. 7, it is possible to provide a structure in which the vacuum feedthrough 16 that corresponds to each of the plate-like electrodes 141 is provided, and these vacuum feedthroughs 16 are connected via the connection line 17. In addition, the fixation section of the connection line 17 may be configured by attaching a connector that corresponds to the vacuum feedthrough at one end of the wire rod.

Figure 8:
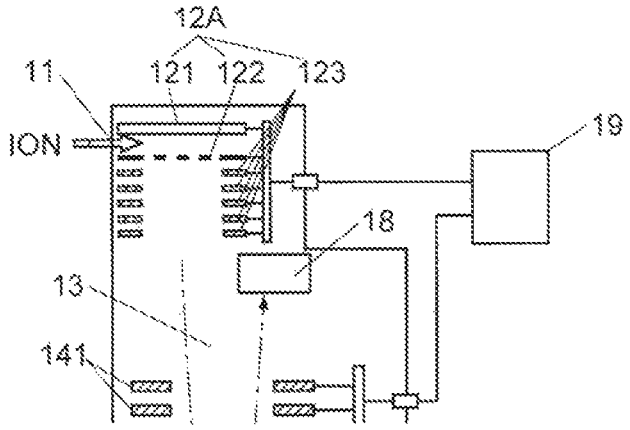
FIG. 8 is a schematic configuration diagram of a main component of a time-of-flight mass spectrometer that includes an acceleration electrode.
Figure 9:
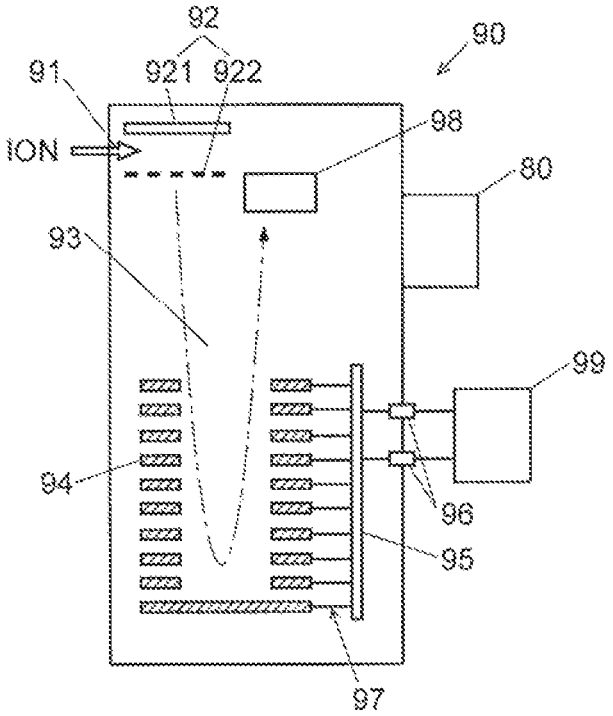
FIG. 9 is a schematic configuration diagram that shows an example of conventional time-of-flight mass spectrometer.

While only a connection structure of a reflection electrode and a power source section for the electrode has been described, a similar connection structure can also be applied to a power source section and another electrode that contributes to transport of an ion in a flight space, such as an extrusion electrode and a grid electrode. For example, as shown in FIG. 8, in addition to the extrusion electrode 121 and the grid electrode (extraction electrode) 122, one or a plurality of acceleration electrodes 123 provided, in their center, with a hole through which an ion passes may be disposed closer to the flight space 13 than the grid electrode 122 is. In this example, the extrusion electrode 121, the grid electrode 122, and the acceleration electrodes 123 collectively forms a stacked electrode, and a connection structure similar to the above is used in the individual electrodes. In addition, a stacked electrode for transporting an ion to the ion introducing section 11 may be provided on the near side of the ion introducing section 11 and a connection structure similar to the above may be applied to the stacked electrode. Moreover, the connection structure shown in the present embodiment can also be applied to various stacked electrodes used as an ion guide electrode of a mass spectrometer other than a time-of-flight mass spectrometer.

REFERENCE SIGNS LIST

10, 90 . . . Time-of-Flight Mass Spectrometer
11, 91 . . . Ion Introducing Section
12, 12A, 92 . . . Ion Accelerating Section
121, 921 . . . Extrusion Electrode
122, 922 . . . Grid Electrode (Extraction Electrode)
123 . . . Acceleration Electrode
13, 93 . . . Flight Space
14, 94 . . . Reflection Electrode
141 . . . Plate-Like Electrode
1411, 1411A . . . Seat
15, 95 . . . Power Source Board
151 . . . Electric Circuit
152 . . . Solder
16, 96 . . . Vacuum Feedthrough
17, 97 . . . Connection Line
171 . . . Fixation Section
172, 172A . . . Spring Section
173, 173A . . . Connector Section
1723 . . . Spring Section And Connector Section
174 . . . Plate Spring
18, 98 . . . Ion Detector
19, 99 . . . Power Source
30, 80 . . . Vacuum Pump

The invention claimed is:

1. A mass spectrometer, comprising:
an electrode;
a power source section that supplies electric power to the electrode with a predetermined voltage and/or current;
a connection line formed of a conductive wire rod having elasticity for electrically connecting the electrode and the power source section;
a connector section provided at one end of the connection line;
a seat provided in the electrode to be contacted with the connector section;
a fixation section provided in the connection line to be fixed to the power source section; and
a spring section formed between the connector section and the fixation section by winding the connection line in the form of helical spring and urging the connector section to contact the seat.

2. The mass spectrometer according to claim 1, wherein the connector section and the seat have an insertion structure in which one is male and another is female.

3. The mass spectrometer according to claim 1, comprising a stacked electrode in which a plurality of the electrodes are arranged at predetermined intervals.

4. The mass spectrometer according to claim 3, wherein the stacked electrode is an ion guide electrode.

5. The mass spectrometer according to claim 3, wherein the stacked electrode is an electrode used for transporting an ion in a flight space of a time-of-flight mass spectrometer.

6. The mass spectrometer according to claim 5, wherein the stacked electrode is a reflectron.

7. The mass spectrometer according to claim 2, comprising a stacked electrode in which a plurality of the electrodes are arranged at predetermined intervals.

8. The mass spectrometer according to claim 7, wherein the stacked electrode is an ion guide electrode.

9. The mass spectrometer according to claim 7, wherein the stacked electrode is an electrode used for transporting an ion in a flight space of a time-of-flight mass spectrometer.

10. The mass spectrometer according to claim 9, wherein the stacked electrode is a reflectron.

* * * * *